United States Patent [19]

Hollen

[11] 4,195,619

[45] Apr. 1, 1980

[54] APPARATUS FOR HEATING THE AIR AND SUIT OF A FREE SWIMMING DIVER

[76] Inventor: James P. Hollen, Rte. 4, Box 965 - Lot 4, High Point, N.C. 27263

[21] Appl. No.: 922,031

[22] Filed: Jul. 5, 1978

[51] Int. Cl.[2] ..... A61F 7/06

[52] U.S. Cl. ..... 126/204

[58] Field of Search ..... 126/204; 128/402, 142.4, 128/142.5

[56] References Cited

U.S. PATENT DOCUMENTS

| | | | |
|---|---|---|---|
| 2,277,772 | 3/1942 | Marick | 219/46 |
| 3,107,669 | 10/1963 | Gross | 123/142 |
| 3,161,192 | 12/1964 | McCormack | 126/204 |
| 3,569,669 | 3/1971 | March | 219/378 |
| 3,657,515 | 4/1972 | Smith | 214/211 |
| 3,730,178 | 5/1973 | Moreland | 128/142 |
| 3,730,178 | 5/1973 | Moreland | 128/142.5 |
| 3,820,540 | 6/1974 | Hirtz | 128/212 |
| 3,898,798 | 8/1975 | Marcus | 126/204 |
| 4,013,122 | 3/1977 | Long | 165/154 |
| 4,014,384 | 3/1977 | Marcus | 165/104 |
| 4,016,878 | 4/1977 | Castel et al. | 128/212 |
| 4,019,511 | 4/1977 | Choporis | 128/212 |
| 4,062,359 | 12/1977 | Geaghan | 128/212 |
| 4,067,064 | 1/1978 | Cariway et al. | 165/46 |

*Primary Examiner*—Albert W. Davis
*Assistant Examiner*—Wesley S. Ratliff, Jr.

[57] ABSTRACT

A heat exchange unit is carried on the back of a free swimming diver and includes small tanks of propane and oxygen and a mixing chamber into which the two gases are fed and mixed. The gaseous mixture is then fed through a burner nozzle and burned to heat the atmosphere in a heat exchange chamber. The chamber includes a first coil therethrough in which air from the main oxygen tank is circulated and heated on its way to the diver's mask. A second coil through the heat exchange chamber carries water or other heating fluid from the diver's suit which is heated and returned.

3 Claims, 2 Drawing Figures

APPARATUS FOR HEATING THE AIR AND SUIT OF A FREE SWIMMING DIVER

BACKGROUND OF THE INVENTION

Several problems face a free swimming diver or skin diver in cold weather or cold waters. In such an environment first of all, the air or oxygen in the tanks of the diver usually attain the same temperature as the water surrounding the diver. Therefore, in winter months or in deep water the air can be extremely cold. When air of such temperature is continuously breathed by the diver, it must be heated before it can be used by the lungs to a temperature of 98.6° F. The energy exerted by the diver's body in heating the air to this temperature saps his energy and reduces the amount of time he can stay submerged. Further, the diver is going to remain more comfortable if the air he breathes is warmer.

When divers are exposed to cold water some type of thermal insulation over the skin is necessary. The most commonly employed method is that of wearing a "wet" suit, however, even so in extremely cold water dives with such a suit are limited to one or two hours duration depending upon the temperature of the water and the activity of the diver. If longer periods or extremely cold water is encountered, additional heat must be provided to keep the body warm.

Known heating techniques for conditioning the air delivered to the diver's mask include battery powered resistance heaters past which the air is circulated, preheated fluid in coils or a catalytic heater past which the air is circulated. These techniques are illustrated and described in the United States patents to Gross U.S. Pat. No. 3,107,669; March U.S. Pat. No. 3,569,669; Marcus U.S. Pat. No. 3,898,978; Marcus U.S. Pat. No. 4,014,384; and Castel et al U.S. Pat. No. 4,016,878. None of these patents is concerned with the heating of the diver's wet suit.

The United States patents to Cerniway et al U.S. Pat. No. 4,067,064 and to Smith U.S. Pat. No. 3,657,515 both show heating of the diver's suit, one by electrical heating elements (Smith), and the other (Cerniway) by a plurality of conduits through which a heating fluid passes. The Smith patent includes an electrical power supply for the heating elements which may be carried with the diver. The suit of Cerniway et al is continuously supplied with heated water from a surface vessel having a hot water source, and as such the unit is not selfenclosed.

Two patents, the Moreland U.S. Pat. No. 3,730,178 and the Long U.S. Pat. No. 4,013,122 each show a technique for heating both the air to the diver's mask and the suit in which the diver is encased. However, both of these patents are directed to a deep sea diving apparatus. The Long patent brings hot water and air from the surface through a conduit down to the diver and the air passes by the hot water in heat exchange relationship thereto just prior to entering the diver's air supply. The Moreland patent utilizes a cryogenic (probably liquid air) material maintained in a tank at a very low temperature, which cryogenic material is then heated by an electric induction heater, and both circulated through the diver's suit and into the diver's mask for breathing purposes. The approach set forth in the Long patent suffers the disadvantage that the air supply cannot be heated unless the hot water supply is also activated.

Also, in the Moreland patent it does not appear that one can easily be used without the other.

SUMMARY OF THE PRESENT INVENTION

In the present invention, however, a different approach is provided wherein a self-contained housing is attached to the back of the diver, preferably attached to the oxygen tanks. The device can be easily applied to existing oxygen breathing systems and heated wet suits which have conduits for circulating a heating fluid. Also, air may be heated alone without using the suit heating means, even if the diver is not even wearing the wet suit.

The heating device of the present invention includes a housing having a heat exchange chamber therein for heating an atmosphere in which a first and second coil extend carrying air and water separately therethrough. The preferred means for heating the atmosphere in the heat exchange chamber is by burning a mixture of propane and oxygen which is mixed and introduced into the heat exchange chamber through a burning nozzle according to known principals.

One of the aforementioned coils receives a heating fluid such as water, as it returns from the conduits in the wet suit and after passing through the heat exchange chamber, sends the heated water back through the conduits. A pump is provided in a separate chamber from the heat exchange chamber for pumping this fluid throughout the suit. The second coil receives oxygen from the oxygen tank on the diver's back and after heating the air as it passes through the heat exchange chamber, delivers the heated oxygen to the diver's face mask. A bleedoff valve is provided for relieving the heat exchange chamber when the pressure builds too high therein.

In some instances, the water in which the diver is submerged may not be cold enough to require heating of the wet suit, while heating of the air is still required. In such a case the inlet and outlet of the conduit through which the heatng fluid passes are plugged, and the pump deactivated so that the apparatus serves only to heat the air.

It is therefore an object of the present invention to provide a simple apparatus for heating both the air (oxygen) and the wet suit of a free swimming diver.

It is another object of the present invention to provide an apparatus of the type described which includes a heat exchange chamber through which the oxygen and heating fluid for the wet suit pass in separate conduits and in which a mixture of propane and oxygen are burned as the heat input materials.

Other objects and a fuller understanding will become apparent from reading the following detailed description of a preferred embodiment along with the accompanying drawings in which.

DETAILED DESCRIPTION OF PREFERRED EMBODIMENT

Figure 1:
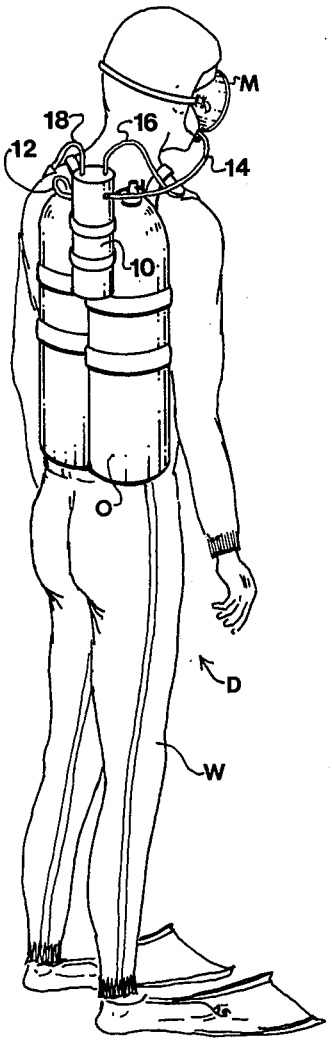
FIG. 1 is a rear elevational view of a heating apparatus according to the present invention as attached to the skin diver.

Turning now to the drawings there is illustrated in FIG. 1 a skin diver D wearing a conventional wet suit W and having attached to his back a pair of oxygen tanks O which deliver breathing air to the diver's mask M. In accordance with the present invention, there is attached to the oxygen tanks O, or to any other convenient location on the diver a heatng apparatus 10 according to the present invention. Oxygen is delivered from tanks O through a tube or conduit 12 into an inlet of the heating device 10 and after being heated, the oxygen is delivered to the breathing mask M through a conduit 14. Also, a heating fluid is returned from the coils or conduits within the wet suit W through a pipe or tube 18 into the heating device 10. After heating the fluid it is returned through pipe or tube 16 into the conduits which extend throughout the wet suit W.

The wet suit with which the present invention is utilized may be one of any number of kinds, as long as it is provided with tubing or pipes therein through which a heating fluid is circulated. For example, one type of suit which would be suitable for use with the present invention would be that shown in the Cerniway et al U.S. Pat. No. 4,067,064. Also the oxygen tanks O and the breathing mask M may be any of several types. One of the features of the present invention is that it may be adapted to any type of wet suit or oxygen supply, and requires no special suit or tank.

Figure 2:
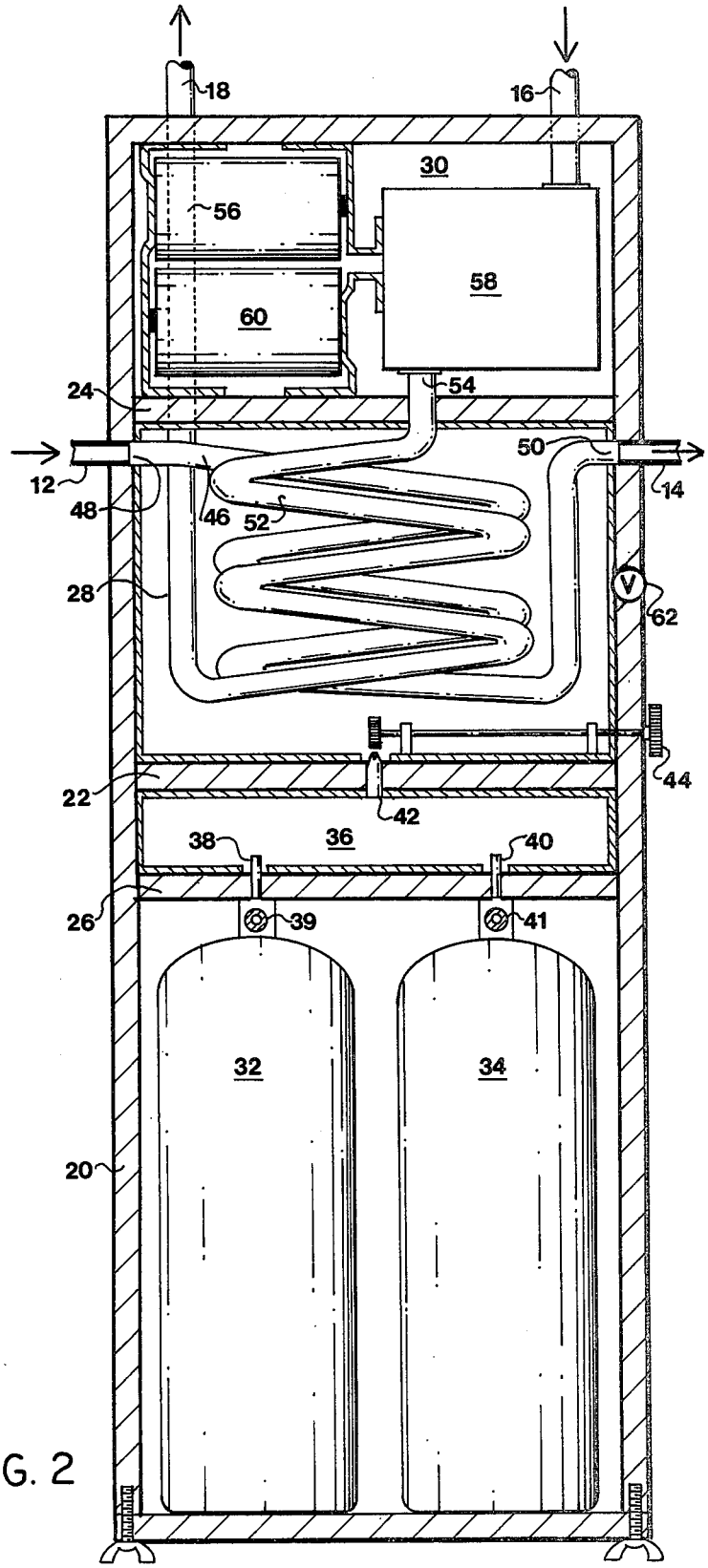
FIG. 2 is an enlarged sectional view through the heat exchange apparatus.

Turning now to FIG. 2 there is illustrated in more detail the heating means or apparatus 10 of the present invention. A housing 20 includes a pair of spaced partitions 22,24 which divide the interior of the housing into a lower chamber 26, a central heat exchange chamber 28, and an upper chamber 30. A pair of tanks 32,34, one carrying propane and the other carrying oxygen are fixed within the lower chamber 26. A manifold 36 includes a pair of inlets 38,40 for receiving propane and oxygen from the tanks and mixing them therein. It is apparent that valves 39,41 which operate each of tanks 32,34 must be controlled from outside the housing, which may be accomplished in a number of ways well known to persons of ordinary skill. As such the manner in which the tanks 32,34 are controlled are of no concern to this invention. Upon mixing, the propane/oxygen mixture is introduced into the heat exchange chamber 28 through a burning nozzle 42 which connects the manifold 36 with the heat exchange chamber 28. A striker mechanism 44 is positioned within the heat exchange chamber 28 in close proximity to the outlet of nozzle 42. Striker mechanism 44 is operable from outside housing 20 to cause a spark to be emitted which ignites the gas being emitted from burner nozzle 42. Striker mechanism 44 may take a variety of forms, however, one which will operate satisfactorily is illustrated in the Choporis et al U.S. Pat. No. 4,019,511 issued Apr. 26, 1977.

A first oxygen conduit 46 is provided in heat exchange chamber 28 and includes an inlet 48 therein for receiving oxygen from the pipe or tube 12. An outlet 50 returns oxygen after it has been heated into the pipe or tube 14 from whence it is delivered to mask M.

A second coil or conduit 52 winds its way through heat exchange chamber 28 separate from the first coil 46. The second conduit 52 includes an inlet 54 which receives a heating fluid such as water from a pump 58, routes the heating fluid through the heat exchange chamber 28, and moves it out through an outlet 56 into the pipe 18 which returns the fluid to the wet suit W. Pump 58, which is battery powered by one or more batteries 60 receives the heating fluid from return pipe 16 leading from the wet suit and continuously keeps the fluid moving through the wet suit.

A bleed valve 62 extends through the side wall of housing 20 connecting the interior of the heat exchange chamber with the atmosphere around the housing 20. Such an arrangement prevents a buildup of pressure within chamber 28 because as pressure reaches a predetermined point the bleed valve 62 is operable to relieve the pressure therein.

In operation, to initiate operation of the heating apparatus, the valves 39,41 which close and open propane and oxygen tanks 32,34 respectively, are opened and the striker mechanism 44 is activated to begin burning of the propane and oxygen mixture. Pump 58 is activated to begin circulation of the fluid through the conduits in the wet suit and through the coil 52 in the heat exchange chamber 28. Oxygen flows into the other coil 46 and is heated before being introduced to the diver's mask.

There is therefore shown and described an apparatus for simultaneously heating and controlling the temperature of the oxygen input to the diver's mask and, if necessary, the temperature of the diver's wet suit, which system is safe, simple, and will last over a considerable length of time while the diver is under water. While a detailed description of a preferred embodiment is described hereinabove, it is apparent that various changes and modifications might be made to the described embodiment without departing from the scope of the invention which is set forth in the claims below.

What is claimed is:

1. A self-contained heating device for heating the air supply and suit of an underwater diver comprising:

(a) an enclosed heat exchange chamber and means for introducing heat into the space therein;

(b) a first coil within said chamber having an inlet and an outlet and a means for attaching said inlet to a source of oxygen and said outlet to a diver's mask;

(c) a second coil within said chamber separate from said first coil and having an inlet and outlet, said inlet and outlet selectively connectable to a diver's suit and receiving a heating fluid therefrom, passing said fluid through said chamber, and returning said fluid to said suit.

2. The heating device according to claim 1 wherein said second coil includes a pump means connected to one of said inlet and outlet for circulating said fluid.

3. The heating device according to claim 1 wherein said means for introducing heat into said heat exchange chamber includes a source of combustible gas stored in a separate chamber and a burner nozzle connecting said separate chamber and said heat exchange chamber for introducing said combustible gas under controlled flow thereinto.

* * * * *